US008070838B1

(12) United States Patent
Kurko

(10) Patent No.: US 8,070,838 B1
(45) Date of Patent: Dec. 6, 2011

(54) FUEL ADDITIVE AND METHOD FOR ITS MANUFACTURE AND USE

(76) Inventor: William R. Kurko, Cave Junction, OR (US)

( * ) Notice: Subject to any disclaimer, the term of this patent is extended or adjusted under 35 U.S.C. 154(b) by 365 days.

(21) Appl. No.: 12/427,608

(22) Filed: Apr. 21, 2009

Related U.S. Application Data

(60) Provisional application No. 61/127,707, filed on May 15, 2008.

(51) Int. Cl.
*C10L 1/18* (2006.01)

(52) U.S. Cl. ..... 44/438; 44/447; 44/451; 44/452

(58) Field of Classification Search ..... 44/438, 44/451, 452, 447
See application file for complete search history.

(56) References Cited

U.S. PATENT DOCUMENTS

| | | | | |
|---|---|---|---|---|
| 3,515,526 | A | | 6/1970 | Cherry |
| 3,902,868 | A | | 9/1975 | Zoch, Jr. |
| 3,980,448 | A | | 9/1976 | Haemmerle et al. |
| 4,265,638 | A | | 5/1981 | Burke |
| 4,451,266 | A | | 5/1984 | Barclay et al. |
| 4,609,379 | A | | 9/1986 | Kitchen |
| 4,682,984 | A | | 7/1987 | Epler |
| 4,806,129 | A | | 2/1989 | Dorn et al. |
| 5,266,082 | A | | 11/1993 | Sanders |
| 5,607,486 | A | * | 3/1997 | Wilkins, Jr. ..... 44/307 |
| 5,656,039 | A | | 8/1997 | Webster, III |
| 5,931,977 | A | | 8/1999 | Yang |
| 5,951,722 | A | | 9/1999 | Sanders et al. |
| 6,123,742 | A | * | 9/2000 | Smith ..... 44/438 |
| 6,258,989 | B1 | | 7/2001 | Owen et al. |
| 6,485,632 | B1 | | 11/2002 | Ward |
| 6,923,838 | B2 | | 8/2005 | Maubert et al. |
| 2003/0217505 | A1 | | 11/2003 | Maubert et al. |
| 2005/0144834 | A1 | | 7/2005 | Jimeson et al. |
| 2005/0229479 | A1 | | 10/2005 | Fernandes |
| 2008/0104884 | A1 | | 5/2008 | Boux et al. |
| 2008/0282607 | A1 | | 11/2008 | Dietz et al. |

* cited by examiner

*Primary Examiner* — Cephia D Toomer
(74) *Attorney, Agent, or Firm* — Jerry Haynes Law

(57) ABSTRACT

An additive composition for use in a liquid fuel containing a mixture of alcohol, aromatic hydrocarbon, acetone, petroleum ether, and mineral oil. The fuel additive is added to a hydrocarbon fuel to reduce pollutants and improve burning efficiency of the fuel. The treated fuel is produced by mixing a sufficient amount of additive to the fuel to produce the desired result.

18 Claims, No Drawings

FUEL ADDITIVE AND METHOD FOR ITS MANUFACTURE AND USE

CROSS-REFERENCE TO RELATED APPLICATIONS

This application claims benefit of U.S. Provisional Patent Application No. 61/127,707, filed on May 15, 2008, and entitled "ULTRA CLEAN FUEL CATALYST".

FIELD OF THE INVENTION

The present disclosure relates to catalysts for use as additives to fossil fuels. More particularly, the present disclosure relates to fuel additives that will substantially eliminate harmful greenhouse gas emissions while providing an increase in fuel efficiency during fossil fuel combustion.

BACKGROUND OF THE INVENTION

Over the last century, the widespread use of liquid fossil fuels as resulted in substantial industrial progress. Notwithstanding current efforts to conserve the world's petroleum resources and to use alternative energy sources such as coal, nuclear, solar, geothermal, and the like, fuel obtained from oil remains our main energy source for everything from vehicles and home heating plants to our largest industrial facilities.

As its use has increased, fossil fuels such as oil, has been the source of much industrial and urban pollution. For example, during combustion, incomplete combustion of the fuel produces toxic carbon monoxide and other harmful emissions. The electric spark and high temperatures also allow oxygen and nitrogen to react and form nitrogen monoxide and nitrogen dioxide, which are responsible for photochemical smog and acid rain. Furthermore, though once very abundant and inexpensive, oil has recently become a very expensive commodity and, because it is a non-renewable resource, oil will become ever more scarce in the future. Our use of it is so universal that even the most optimistic predictions of achieving transition to alternatives forecast many years of high consumption.

Accordingly, efforts have been directed to improving the performance of machinery using fossil fuels or liquid hydrocarbon fuels, for example, by increasing the miles per gallon of automobiles. In part this has involved redesign of the machinery which uses the fuel. Another tactic has been to change the combustion characteristics of the fuel itself by refining and by the use of additives. Although there have been substantial efforts made to improve hydrocarbon fuels by supplementing them with various additives, these efforts have not enjoyed widespread acceptance or much success because of one shortcoming or another. Accordingly, there has long been, and still remains, a need for an inexpensive yet effective additive for liquid fossil fuels to provide cleaner combustion and fuel improve efficiency. It would be desirable to utilize fuel additive that, when added to fossil fuels, uses less fuel, produces reduced emissions while maintaining the same BTU output during combustion. It is a primary object of my invention to provide such a fuel additive.

SUMMARY OF THE INVENTION

An additive composition for use in a liquid fuel containing a mixture of alcohol, aromatic hydrocarbon, acetone, petroleum ether, and mineral oil. The fuel additive is added to a hydrocarbon fuel to reduce pollutants and improve burning efficiency of the fuel. The treated fuel is produced by mixing a sufficient amount of additive to the fuel to produce the desired result.

DESCRIPTION OF THE INVENTION

I have developed a new additive composition, used to treat liquid fuels, comprising various mixtures of ingredients. One ingredient is alcohol. Preferably I use a low molecular weight alcohol, that is, an alcohol having four or fewer carbon atoms. Such alcohols include methanol, ethanol, propanol, isopropanol, butanol, and mixtures thereof. The alcohol will comprise, on a volume/volume basis at ambient temperature, about 62 to about 82 percent of the additive, preferably about 70 to about 75 percent. For additives for gasoline, I typically use ethanol and for gasohol I prefer isopropanol.

A second ingredient of the additive is an aromatic hydrocarbon. Preferably I use benezene or a benezene derivative such as toluene, xylene, naphthalene, biphenyl and mixtures thereof. The aromatic hydrocarbon will comprise, on a volume/volume basis at ambient temperature, about 5 to about 15 percent of the additive, preferably about 8 to about 10 percent.

A third ingredient of the additive is acetone which is an organic compound with the formula $OC(CH_3)_2$ also known as dimethyl ketone, DMK, or propanone. The acetone will comprise, on a volume/volume basis at ambient temperature, about 5 to about 15 percent of the additive, preferably about 8 to about 10 percent.

A fourth ingredient of the additive is petroleum either that includes a group of various volatile, liquid hydrocarbon mixtures of non-polar solvents known as benzine, VM&P Naphtha, Naphtha ASTM, Petroleum Spirits, X4, or Ligroin. The petroleum ether will comprise, on a volume/volume basis at ambient temperature, about 5 to about 20 percent of the additive, preferably about 7 to about 12 percent.

A fifth ingredient of the additive is mineral oil or liquid petroleum is a by-product in the distillation of petroleum to produce gasoline another petroleum based products from crude oil. It is composed mainly of alkanes, typically 15 to 40 carbons, and cyclic paraffin, related to white petroleum. The mineral oil will comprise, on a volume/volume basis at ambient temperature, about at least 0.00001 percent of the additive, preferably about at least 0.000015 percent.

In practice to treat the desired fuel, I first blend the ingredients in for example a 55 gallon drum at room temperature to produce an additive according to my invention. I then introduce, by splash blending for example, the additive in sufficient quantities to the fuel to improve the efficiency with which the fuel burns or operates in an engine or its other operating characteristics. The amount which will provide optimum results can vary depending upon the type and quality of the fuel, engine or burner design and the like.

Regarding specific fuels to be treated, I have found, for example, that by mixing my fuel additive to gasoline or gasohol fuel in a ratio of about 0.25 to about 4.0 ounces of additive to about one gallon of fuel produces superior results. For diesel fuel for use with cars, trucks, trains, marine and small engines, and the like, I prefer to use a ratio of about 1.0 to about 5.0 ounces of additive to about one gallon of fuel. For diesel fuels such as heating oil or as smudge pot fuel, I have found that I obtain better results by using a ratio of about 0.25 to about 3.0 gallons of additive to about 32 gallons of fuel.

For bunker fuels, before introducing my additive, I generally preheat the bunker fuel above ambient temperature, typically using higher temperatures for heavier bunker fuels to provide ease of blending in the additive. Typical bunker fuels include, without limitation, #2, #4, #6, and #8 bunker fuels used in marine and industrial boilers. Depending on the type of bunker fuel, I typically use a ratio of about 0.25 to about 3.0 gallons of additive to about 30 to 40 gallons of bunker fuel.

For recycled fuel oil used in place of diesel in industrial boiler for example, before introducing my additive, I generally first clean the fuel by standard methods including centrifuging or passing it through a filter. I then heat the cleaned fuel above ambient temperature to facilitate ease of blending with the additive. I prefer to use a ratio of about 0.25 to about 3.0 gallons of additive to about 40 gallon of recycled fuel oil.

EXAMPLES

Having described my invention, I now provide the following examples to illustrate specific applications of my invention, including the best mode now known to perform the invention. I do not intend for these examples to limit the scope of my invention as I have described in this application.

Example 1

Treatment of Gasoline

Additive Formulation #1 is provided for treatment of gasoline (without ethanol added to the fuel) for use with cars, trucks, recreation vehicles and small engines that burn gasoline. Into a standard 55 gallon drum at ambient temperature, was blended 40.15 liquid gallons or 73% of total volume of 55 gallon container of tech grade ethyl alcohol $C_2H_5OH$., 4.95 liquid gallons or 9% of total volume of 55 gallon container of tech grade Acetone $OC(CH_3)_2$, 4.95 liquid gallons or 9% of total volume of 55 gallon container of tech grade Xylene $C_8H_{10}$, 4.95 liquid gallons or 9% of total volume of 55 gallon container of tech grade VM&P Naphtha, composition of $C_8$ $C_9$, 5 liquid milliliters or 0.000024% of total volume of 55 gallon container of Hydro treated Distillate light Naphthenic Oil. The components are blended through splash blending.

Additive Formulation #1 is then introduced into the gasoline at ambient temperature blending one ounce of the additive to one gallon of gasoline fuel by splash blending.

The resulting treated gasoline was then tested for physical properties in a 2002 Acura MDX, with a 3.5 L. V. Tech. engine using regular gas having the additive. Prior to commencing the test on Apr. 23, 2007 the vehicle had 47,228 miles and was averaging 19.63 miles per gallon and the emissions at idle were HC 24 PPM, $CO_2$ 15.5%, CO 0.01%, $O_2$ 0.0% and $NO_x$ 2 PPM. The time frame for the test was four months using Formulation #1 each day and the results were recorded periodically.

The driving conditions during the approximate four month test period with 4062 miles driven were substantially the same as the conditions prior thereto. The emission tests were conducted with a Ferret Gas link II, and a Snap-on 5 gas emissions analyzer. Both analyzers were calibrated by a certified mechanic.

During the test period the MPG increased to an average of 23.12 from 19.63 or an increase of 3.49 MPG or 17.8%. The emissions at idle decreased to HC 0 PPM or 100%, $CO_2$ 14.4% or 7.09% decrease, CO 0.01% to 0.0% or 100% decrease, $O_2$ 0.0% to 0.13% or an increase of 0.13 from a base of zero, and $NO_x$ 2 PPM to 0 PPM, a 100% decrease. The emissions at 2500 RPM's decreased from 101 PPM HC to 3 PPM HC or 97% decrease, $CO_2$ from 15.6% to 14.5% or a 7% decrease, CO 0.01% to 0.0% or 100% decrease, $O_2$ 0.0% to 0.18% or an increase of 0.18 from a base of zero, and $NO_x$ 101 PPM to 58 PPM, a 42% decrease.

Example 2

Treatment of Gasohol

Additive Formulation #2 is provided for treatment of gasoline with ethanol fuel (sometimes referred to as "gasohol") for use with cars, trucks, recreation vehicles and small engines that burn gasoline. Into a standard 55 gallon drum at ambient temperature, was blended 40.15 liquid gallons or 73% of total volume of 55 gallon container of tech grade Isopropyl alcohol $C_3H_7OH$, 4.95 liquid gallons or 9% of total volume of 55 gallon container of tech grade Acetone $OC(CH_3)_2$, 4.95 liquid gallons or 9% of total volume of 55 gallon container of tech grade Xylene $C_8H_{10}$, 4.95 liquid gallons or 9% of total volume of 55 gallon container of tech grade VM&P Naphtha, composition of $C_8$ $C_9$, 5 liquid milliliters or 0.000024% of total volume of 55 gallon container of Hydro treated Distillate light Naphthenic Oil. The components are blended through splash blending.

Formulation #2 is introduced to the gasohol at ambient temperature blending one ounce of additive to one gallon of gasoline fuel by splash blending. The resulting treated gasohol was then tested for physical properties in a 2002 Acura MDX, with a 3.5 L. V. Tech. engine using regular gas having the additive. Prior to commencing the test on Aug. 25, 2007, the vehicle had 52,411 miles and was averaging 19.63 miles per gallon and the emissions at idle were HC 24 PPM, $CO_2$ 15.5%, CO 0.01%, $O_2$ 0.0% and $NO_x$ 2 PPM. The time frame for the test was three months using the fuel catalyst each day and recording the results periodically.

The driving conditions during the approximate three month test period with 6326 miles driven were substantially the same as the conditions prior thereto. Formulation #2 was used each day and the results were recorded periodically. The emission tests were conducted with a Ferret Gas link II, and a Snap-on 5 gas emissions analyzer, both analyzers were calibrated by a certified mechanic.

During the test period the MPG increased an average of 1.58 from a base average of 19.63, an increase of 1.58 MPG or 8.03%. The emissions at idle decreased to HC 0 PPM or 100%, $CO_2$ from 15.5% to 13.6% or 13.8% decrease, CO 0.01% to 0.0% or 100% decrease, O2 0.0% to 0.2% or an increase of 0.2 from a base of zero, and $NO_x$ 2 PPM to 17 PPM, an increase of 15 PPM. The emissions at 2500 RPM's decreased from 101 PPM HC to 0 PPM HC or 100% decrease, $CO_2$ from 15.6% to 14.5% or a 7% decrease, CO 0.01% to 0.0% or 100% decrease, $O_2$ 0.0% to 0.1% or an increase of 0.1 from a base of zero, and $NO_x$ 101 PPM to 76 PPM, a 25% decrease.

Example 3

Treatment of #2 Diesel Fuel

Additive Formulation #2 was prepared as described in Example 2 for use with cars, trucks, trains, marine, and small engines that burn #2 diesel. Formulation #2 is introduced to the #2 diesel at ambient temperature blending three ounces of Formulation #2 to one gallon of #2 diesel fuel by splash blending.

The resulting treated #2 diesel fuel was then tested for physical properties in a 2000 Argosy Freightliner, with a diesel Caterpillar C12 410 HP motor with a five inch stack that powered the tractor unit on the Semi Truck. Prior to commencing the test on Aug. 10, 2008 the vehicle had over 500,000 miles on the chasse with a rebuilt engine. The truck was averaging 5.81 miles per gallon and the emissions without treatment averaged 49.25%. The time frame for the test was four months using the fuel catalyst each day and the results were recorded periodically.

The driving conditions during the four month test period with over 25,000 miles driven were substantially the same as the conditions prior thereto. We used a Wagner digital smoke meter model 6500 and preformed (4) snap tests on the unit with the Formulation #2 and (2) two snap tests without treatment. The snap test consists of three max revs of the engine and an average is taken of the three snaps for one opacity percentage. The opacity meter reads the maximum smoke density from revving the engine or (snap).

During the test period the MPG increased to an average of 7.29 MPG from 5.81 MPG. This was a 1.31 MPG increase or 20.37%. The density of the emissions from opacity tests of the smoke decreased substantially using Formulation #2 from an average 49.25% without treatment to 2.95% using Formulation #2.

Example 4

Treatment of Heating Oil

Additive Formulation #2 was prepared as described in Example 2 for use with use with #2 diesel fuel for use as heating oil in "smudge pots" for orchard heating that burn #2 diesel. Formulation #2 is introduced to the #2 diesel at ambient temperature blending one quart of the Formulation #2 to eight gallons of #2 diesel fuel by splash blending.

The resulting treated heating oil was then tested for physical properties in two separate tests. The tests were with Myers Orchard, Talent Oregon and Harry and David Orchards, Medford Oregon. The test with Myers was conducted two times for visible particulate smoke, during the winter and spring of 2008. This same time period, Mr. Myers tested the product for fuel efficiency when he used the fuel catalyst in #2 Diesel to heat his orchard. Both tests also used identical smudge pots of similar condition and made by same manufacturer. The test with Harry and David during the winter and spring of 2008, testing the product for emissions and particulates left on leaves after using the smudge pots for heating. Harry and David to certify their fruit as organic needed a product that would not leave smoke residue from smudging using #2 diesel.

During the test period, Mr. Myers stated that using the Formulation #2 in #2 diesel gave him cost savings from efficiency gains in extending burn time of the fuel. The two tests for visible smoke particulates show little or no visible particulates using the fuel catalyst compared to very dense, thick smoke in #2 diesel without the fuel catalyst. Local Medford Oregon TV station channel 5 News did a report on the results verifying no visible smoke emissions from #2 diesel treated with Formulation #2. Harry and David used cotton swabs to swab buds and leaves of fruit trees during the test period and reported no particulate residue on swabbed tree growth after smudging using Formulation #2. Without treatment, Harry and David reported particulate residue that would have disqualified them from certifying their fruit organic smudging with #2 diesel without treatment.

Example 4

Treatment of Bunker Fuel

Additive Formulation #2 was prepared as described in Example 2 for use with use with #2 diesel fuel for use with #2, #4, #6, #8 bunker fuels for use in marine and industrial use boilers. Formulation #2 at ambient temperature is introduced into the #2 bunker fuel heated to 110 degrees Fahrenheit, blending one gallon of the Formulation #2 to forty gallons of #2 Bunker fuel by splash blending. Formulation #2 at ambient temperature is introduced into the #4 bunker fuel heated to 125 degrees Fahrenheit, blending one gallon of the Formulation #2 to thirty five gallons of #4 Bunker fuel by splash blending. Formulation #2 at ambient temperature is introduced into the #6 bunker fuel heated to 145 degrees Fahrenheit, blending one gallon of the Formulation #2 to thirty gallon of #6 bunker fuel by splash blending. Formulation #2 at ambient temperature is introduced into the #8 bunker fuel heated to 160 degrees Fahrenheit, blending one gallon of Formulation #2 to thirty gallons of #8 bunker fuel by splash blending.

Bunker fuels treated with Formulation 32 have not been tested. The densities of bunker fuels are similar to the Recycled Fuel Oil ("RFO") that has been tested. I believe therefore that the bunker fuels will have similar results as the RFO tests. RFO was tested for physical properties in two 350,000 BTU Boilers at a RFO plant. The time frame for the test was four months using the fuel catalyst each day and recording the results periodically. The test period began April of 2008 and continued through July 2008. The time frame for the test was four months using the Formulation #2 each day and recording the results periodically.

During the test period the volume of fuel used in a twelve hour period of burn time was reduced from approximately 125 gallons to 85 gallons, a reduction of 32%. The boiler operators reported better ignition starts, no ignition failures, a hotter burn with less ash and a cleaner burn. The maintenance time was extended from 400 hours to 575 hours with no carbon buildup in stack or ignition system or nozzles, reducing maintenance costs.

Example 4

Treatment of Recycled Fuel Oil

Additive Formulation #2 was prepared as described in Example 2 for use with Recycled Fuel Oil (RFO), for use in place of #2 diesel fuel and in industrial use boilers. This is a process that first takes RFO and cleans the oil by use of a two micron filter or centrifuge. The cleaned RFO is then heated to 140 degrees Fahrenheit and is blended with the fuel catalyst. Formulation #2 at ambient temperature is splash blended using one gallon of Formulation #2 to forty gallons of the heated RFO. The treated RFO makes an economical, ultra clean fuel with significant higher BTU's which is used in boiler applications and substitutions for #2 diesel fuels.

The resulting treated RFO was then tested for physical properties in two 350,000 BTU Boilers at a RFO plant. The time frame for the test was four months using the fuel catalyst each day and recording the results periodically. The test period began April of 2008 and continued through July 2008. The time frame for the test was four months using the fuel catalyst each day and recording the results periodically.

During the test period the volume of fuel used in a twelve hour period of burn time was reduced from approximately 125 gallons to 85 gallons, a reduction of 32%. The boiler operators reported better ignition starts, no ignition failures, a hotter burn with less ash and a cleaner burn. The maintenance time was extended from 400 hours to 575 hours with no carbon buildup in stack or ignition system or nozzles, reducing maintenance costs.

Reasonable variations, modifications, and adaptations can be made within the scope of the disclosure and the appended claims without departing from the scope of my invention.

I claim:

1. A fuel additive composition for use in a liquid fuel, on a volume/volume basis at ambient temperature, comprising:

a. about 62 to about 82 percent alcohol;

b. about 5.0 to about 15 percent aromatic hydrocarbon;

c. about 5.0 to about 15 percent acetone;

d. about 5.0 to about 20 percent petroleum ether and e. at least about 0.00001 percent mineral oil.

2. The fuel additive composition of claim 1 wherein the alcohol is selected from the group consisting of methanol, ethanol, propanol, isopropanol, butanol and mixtures thereof.

3. The fuel additive composition of claim 1 wherein the aromatic hydrocarbon is selected from the group consisting of benzene, toluene, xylene, naphthalene, biphenyl and mixtures thereof.

4. The fuel additive composition of claim 1 wherein the petroleum ether is VM&P Naphtha.

5. The fuel additive composition of claim 1 wherein the mineral oil is naphthenic oil.

6. The fuel additive of claim 1 wherein the additive comprises:

a. about 70 to about 75 percent alcohol;

b. about 8.0 to about 10 percent aromatic hydrocarbon;

c. about 8.0 to about 10 percent acetone;

d. about 7.0 to about 12 percent petroleum ether; and e. at least about 0.000015 percent mineral oil.

7. A fuel additive for use in a liquid fuel, selected from the group consisting of gasoline, gasohol, diesel, heating oil, bunker fuel, and recycled fuel oil consisting essentially of:

a. about 62 to about 82 volume percent alcohol;

b. about 5.0 to about 15 volume percent aromatic hydrocarbon;

c. about 5.0 to about 15 volume percent acetone;

d. about 5.0 to about 15 volume percent petroleum ether; and e. at least about 0.00001 volume percent mineral oil.

8. The fuel additive composition of claim 7 wherein the alcohol is selected from the group consisting of methanol, ethanol, propanol, isopropanol, butanol and mixtures thereof.

9. The fuel additive composition of claim 7 wherein the aromatic hydrocarbon is selected from the group consisting of benzene, toluene, xylene, naphthalene, biphenyl and mixtures thereof.

10. The fuel additive composition of claim 7 wherein the petroleum ether is VM&P Naphtha.

11. The fuel additive composition of claim 7 wherein the mineral oil is naphthenic oil.

12. A method for treating a liquid fuel, the method comprising the steps of:

a. providing a fuel additive consisting essentially of alcohol, aromatic hydrocarbon, acetone, petroleum ether, and mineral oil; and b. blending the fuel additive with the liquid fuel, selected from the group consisting of gasoline, gasohol, diesel, jet fuel, heating oil, bunker fuel, and recycled fuel oil to provide a treated liquid fuel wherein the alcohol is present in an amount of about 62 to about 82 percent by volume, based upon a total volume of additive; the aromatic hydrocarbon is present in an amount of about 5.0 to about 15 percent by volume, based upon a total volume of additive; the acetone is present in an amount of about 5 to about 15 percent by volume, based upon a total volume of additive; the petroleum ether is present in an amount of about 5.0 to about 15 percent by volume, based upon a total volume of additive; and the mineral oil is present in the amount of at least about 0.00001 percent by volume, based upon a total volume of additive.

13. The method of claim 12 wherein the liquid fuel is gasoline and the fuel additive is blended with the gasoline at a ratio of about 0.25 to about 4 ounces of additive to about one gallon of gasoline.

14. The method of claim 12 wherein the liquid fuel is diesel and the fuel additive is blended with the diesel at a ratio of about 1.0 to about 5.0 ounces of additive to about one gallon of diesel.

15. The method of claim 12 wherein the liquid fuel is bunker fuel and the fuel additive is blended with the bunker fuel at a ratio of about 0.25 to about 3.0 gallons of additive to about 30 to about 40 gallons of bunker fuel.

16. The method of claim 12 wherein the liquid fuel is recycled fuel oil and further comprises the steps of filtering the recycled oil, heating the recycled oil and blending the fuel additive with the recycled fuel oil at a ratio of about 0.25 to about 3.0 gallons of additive to about forty gallons of recycled fuel oil.

17. The method of claim 12 wherein the liquid fuel is smudge pot fuel and the fuel additive is blended with the heating oil at a ratio of about 0.25 to about 3.0 gallons of additive to about 32 gallons of smudge pot fuel.

18. The method of claim 12 wherein the alcohol is selected from ethanol and isopropanol and mixtures thereof; the aromatic hydrocarbon is xylene; the petroleum ether is VM&P Naphtha; and the mineral oil is naphthenic oil.

* * * * *